US006881034B1

(12) United States Patent
Riggs

(10) Patent No.: US 6,881,034 B1
(45) Date of Patent: Apr. 19, 2005

(54) LEAF ROTOR

(76) Inventor: Thomas J. Riggs, 2415 Girard, Warren, MI (US) 48092

( * ) Notice: Subject to any disclaimer, the term of this patent is extended or adjusted under 35 U.S.C. 154(b) by 0 days.

(21) Appl. No.: 10/348,986

(22) Filed: Jan. 23, 2003

Related U.S. Application Data

(60) Provisional application No. 60/350,365, filed on Jan. 24, 2002.

(51) Int. Cl.[7] ..... F04D 29/18
(52) U.S. Cl. ..... 416/91; 416/90 A
(58) Field of Search ..... 415/80; 416/90 R, 416/90 A, 91, 92, 176

(56) References Cited

U.S. PATENT DOCUMENTS 933,199 A 9/1909 Otto
1,473,066 A 11/1923 Wells
1,597,175 A 8/1926 Boening
1,604,994 A * 11/1926 Grosso et al. ..... 416/91
2,103,243 A * 12/1937 Bradford, Jr. ..... 416/91
2,209,607 A 7/1940 Nutting
5,037,209 A * 8/1991 Wyss ..... 366/246

FOREIGN PATENT DOCUMENTS

GB 2064668 A * 6/1981

* cited by examiner

*Primary Examiner*—Ninh H. Nguyen
(74) *Attorney, Agent, or Firm*—Patent & Trademark Services Inc.; Joseph H. McGlynn

(57) ABSTRACT

A rotor which has a cone shaped tube with a large air input end and a smaller air output end. The cone shaped tube increases air pressure as the air passes through the tube and provides more lift.

7 Claims, 1 Drawing Sheet

LEAF ROTOR

This application claims benefit of provisional application 60/350,365 filed Jan. 24, 2002.

BACKGROUND OF THE INVENTION

This invention relates, in general, to rotors, and in particular, to rotors with a specific design that increases the velocity of the air moved through the rotor.

DESCRIPTION OF THE PRIOR ART

In the prior art various types of rotors have been proposed. For example, U.S. Pat. No. 2,209,607 to Nutting discloses a rotor which has a air intake which is connected to a curved impeller housing.

U.S. Pat. No. 1,597,175 to Boening discloses a propeller having curved semicircular ends on the blades.

U.S. Pat. No. 1,473,066 to Wells discloses a fan for automobiles which has a variety of curve shapes on the sides of the fan blades.

U.S. Pat. No. 933,199 to Otto discloses an air propeller having two blades with curved shapes.

SUMMARY OF THE INVENTION

The present invention is directed to a rotor which has a cone shaped tube with a large air input end and a smaller air output end. The cone shaped tube increases air pressure as the air passes through the tube and provides more lift.

It is an object of the present invention to provide a new and improved design for a rotor.

It is an object of the present invention to provide a new and improved design for a rotor which will increase lift.

It is an object of the present invention to provide a new and improved design for a rotor which is economical to build.

These and other objects and advantages of the present invention will be fully apparent from the following description, when taken in connection with the annexed drawings.

DESCRIPTION OF THE PREFERRED EMBODIMENT

Figure 1:
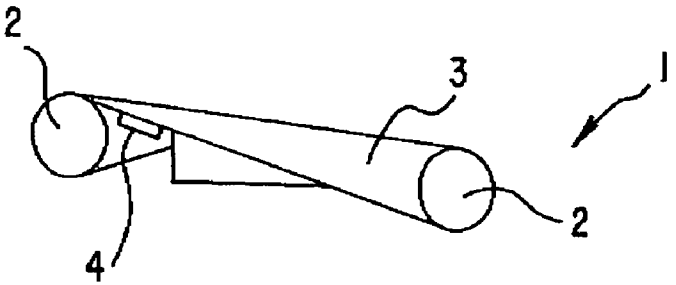
FIG. 1 is a side view of the present invention.
Figure 3:
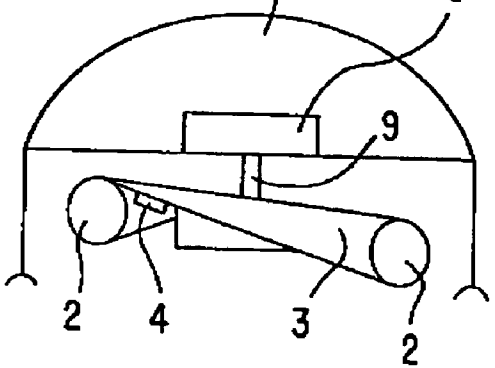
FIG. 3 is a partial view showing the rotor secured to a craft.

Referring now to the drawings in greater detail, FIG. 1 shows a side view of the rotor 1 of the present invention. It should be noted that the rotor of the present invention could be used with any type of device which uses a rotor, such as, but not limited to, aircraft, impellers, windmills and fan blades. FIG. 3 shows the present invention used with a Ground Effect Machine (GEM) 7 that has a conventional motor 8 which is connected to the rotor of the present invention by a conventional shaft 9, however, it should be understood that this is merely for illustrational purposes, and the present invention could be used with any type of craft that requires lift to operate.

As shown in FIG. 1, the rotor has an air inlet 2 at one end of the body or tube 3. It should be noted that while the preferred shape of the tube 3 is a cone, other curved shapes could be used without departing from the scope of the present invention. Also, the rotor body has an air outlet 4 at the end of the tube 3 which is opposite the end having the inlet 2. As shown in FIG. 1 the air inlet 2 and the outlet 4 for the tube 3 on the right are shown, however, only the inlet 2 for the tube on the left is shown because of the triangular configuration (see FIG. 2) of the rotor.

Figure 2:
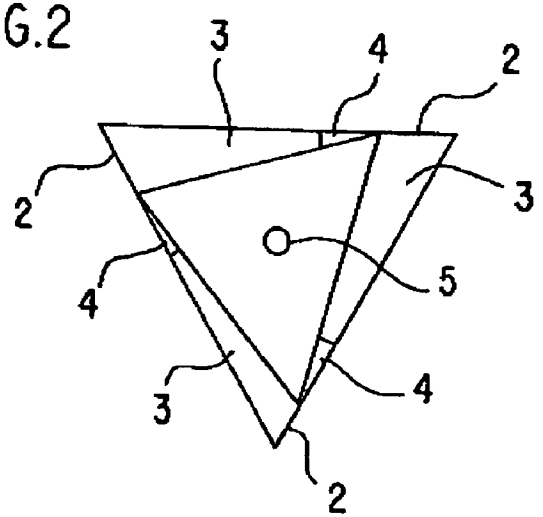
FIG. 2 is a bottom view of the present invention.

As shown in FIG. 2, the rotor could have a plurality of bodies 3 which are formed in a triangular shape and, all of which have a center of rotation with an aperture 5 that could be used to connect the rotor of the present invention to a shaft of a motor 9, as shown in FIG. 3. Any conventional motor could be used to rotate the rotor 1 about the center of rotation.

Also, the rotor of the present invention could be made from any conventional material which would be normally used in a conventional application of the rotor.

In use, as the rotor spins around the center of rotation, air is forced into the inlets 2 where continued rotation of the rotor 1 would force the air through the tube 3. The inlet air will then be forced through the outlet 4. Since the inlet openings 2 are larger than the outlets 4, the velocity of the air will increase as it is forced from the inlet 2 through the outlets 4. Since the diameter of the tubes 3 become smaller as they approach the outlets 4, the same volume of air must occupy a smaller area which will increase the speed of the air through the tube 3.

As shown in FIG. 1, the outlets 4 are positioned downwardly with respect to the body of the rotor 1. This will force the air downwardly as it exits the tube 3. As the air moves downwardly through the exits 4, it will provide lift to the craft 7 that it is attached to. It should be noted that this positioning of the outlets is designed to provide lift to the GEM shown in FIG. 3, however, if the rotor is used on other types of vehicles, the outlets could be placed in a different position depending on the type of vehicle the rotor is used with.

Although the Leaf Rotor and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A rotor adapted to be used with a vehicle, said rotor comprising:

a plurality of tubes, said tubes being connected together, each of said plurality of tubes having an inlet end and an outlet end, each of said tubes having a first dimension at said inlet end, and a second dimension at said outlet end, and wherein said first dimension is larger than said second dimension, and wherein said inlet ends have an inlet aperture, and said outlet ends have an outlet aperture, and wherein each of said outlet apertures are positioned adjacent said outlet end of said tubes, and said outlet apertures have a longitudinal axis, and said longitudinal axis of said outlet apertures are positioned at an angle of less than 180° with respect to a longitudinal axis of said tubes, and wherein there are three tubes positioned in a triangular shape.

2. The rotor as claimed in claim 1, wherein each of said inlet apertures are positioned in an end of said tubes, and said inlet apertures are coaxial with a longitudinal axis of said tubes.

3. The rotor as claimed in claim 1, wherein each of said tubes are conically shaped.

4. A rotor adapted to be used with a vehicle, said rotor comprising:

a plurality of tubes, said tubes being connected together, each of said plurality of tubes having an inlet end and an outlet end, each of said tubes having a first dimension at said inlet end, and a second dimension at said outlet end, and wherein said first dimension is larger than said second dimension, and wherein said inlet ends have an inlet aperture, and said outlet ends have an outlet aperture, and wherein each of said tubes has a top surface and a bottom surface, and a first end and a second end extending between said top surface and said bottom surface, and each of said inlet apertures is positioned in said first end, and each of said outlet apertures is positioned in said bottom surface at said second end, and wherein there are three tubes positioned in a triangular shape.

5. The rotor as claimed in claim 4, wherein said tubes are conically shaped.

6. The rotor as claimed in claim 4, wherein said inlet ends have an inlet aperture, and said outlet ends have an outlet aperture.

7. The rotor as claimed in claim 6, wherein each of said inlet apertures are positioned in an end of said tubes, and said inlet apertures are coaxial with a longitudinal axis of said tubes.

* * * * *